US010463089B2

(12) United States Patent
Cheuk et al.

(10) Patent No.: US 10,463,089 B2
(45) Date of Patent: Nov. 5, 2019

(54) BACK ENTRY ZIPPERLESS WETSUIT

(71) Applicant: Stallion Sport Limited, San Po Kong, Kowloon (HK)

(72) Inventors: Shuen Piu Cheuk, Fanling (HK); Fan Wung Aylwin Tsang, Kowloon (HK)

(73) Assignee: Stallion Sport Limited, Hong Kong (HK)

( * ) Notice: Subject to any disclaimer, the term of this patent is extended or adjusted under 35 U.S.C. 154(b) by 407 days.

(21) Appl. No.: 15/335,681

(22) Filed: Oct. 27, 2016

(65) Prior Publication Data

US 2018/0116305 A1 May 3, 2018

(51) Int. Cl.

| | |
|---|---|
| ***B63C 11/04*** | (2006.01) |
| ***A41D 13/012*** | (2006.01) |
| ***A41D 27/18*** | (2006.01) |
| ***A41F 1/00*** | (2006.01) |

(52) U.S. Cl.

CPC ..... *A41D 13/012* (2013.01); *A41D 27/18* (2013.01); *A41F 1/002* (2013.01); *B63C 11/04* (2013.01); *A41D 2300/32* (2013.01); *A41D 2400/10* (2013.01); *A41D 2400/44* (2013.01); *A41D 2400/70* (2013.01); *A41D 2500/50* (2013.01); *B63C 2011/046* (2013.01)

(58) Field of Classification Search

CPC ..... A41D 13/012; A41D 27/18; A41D 27/16; A41D 27/208; A41F 1/002; B63C 2011/046; B63C 11/08

USPC ..... 2/2.17, 2.16

See application file for complete search history.

(56) References Cited

U.S. PATENT DOCUMENTS

| | | | | |
|---|---|---|---|---|
| 5,630,229 | A * | 5/1997 | Machado | A41D 13/012 2/2.15 |
| 7,395,553 | B2 * | 7/2008 | O'Hara | A41D 13/012 2/2.15 |
| 2007/0067886 | A1 * | 3/2007 | Hunter | B63C 9/087 2/2.16 |
| 2010/0100994 | A1 * | 4/2010 | Ehlme | A41D 13/012 2/2.16 |
| 2014/0259262 | A1 * | 9/2014 | Schreiber, Sr. | A41B 3/18 2/46 |
| 2014/0277101 | A1 * | 9/2014 | Smith | A61B 17/1325 606/202 |
| 2016/0135508 | A1 * | 5/2016 | Lawrence | A41B 3/18 2/129 |

* cited by examiner

*Primary Examiner* — Timothy K Trieu
(74) *Attorney, Agent, or Firm* — Raymond Sun

(57) ABSTRACT

A wetsuit has a back, an access opening at the neck portion, and a closure system provided at the access opening. The closure system has an internal gasket made of a generally V-shaped piece of flexible material having an upper edge and two side edges, and a collar connected to the upper edge of the gasket. An inner flap is hingedly attached to one of the side edges of the gasket, and has an outwardly-facing surface, with at least one Velcro™ pad provided thereon. An outer flap is hingedly attached to another of the side edges of the gasket, and has an inwardly-facing surface, with at least one Velcro™ pad provided thereon.

13 Claims, 5 Drawing Sheets

20
22
24
26
28
30
32

24
120
136
134
144
154
140
158
146
160
156
152
138

BACK ENTRY ZIPPERLESS WETSUIT

BACKGROUND OF THE INVENTION

1. Field of the Invention

The present invention relates to aquatic equipment, and in particular, to a zipperless neoprene wetsuit.

2. Description of the Prior Art

Wetsuits are commonly used for swimming, diving and many other water activities. For competitive swimming activities such as Triathlon or open-water swimming, a neoprene wetsuit is allowed during colder water temperatures.

Neoprene or polychloroprene is a family of synthetic rubbers. Neoprene exhibits good chemical stability and maintains flexibility over a wide temperature range. Swimming wetsuits made of neoprene are different from other types of wetsuits, such as surfing or diving wetsuits, where drag reduction is a major concern. For this reason, wetsuits made of neoprene are always constructed only with a back zipper entry closure, which allows the front body panel to be sleek and smooth.

Unfortunately, zippers are quite bulky, lengthy and not flexible. These drawbacks hinder swimming movements and reduce the overall flexibility of the wetsuit. In addition, a rigid zipper in the lower back area will also form a cavity where water will accumulate, making it uncomfortable to the swimmer and slowing down the swimming motion.

Thus, there is a need to provide an improved neoprene wetsuit that avoids the drawbacks described above. In response, efforts have been made to provide a zipperless wetsuit. Unfortunately, designing a zipperless wetsuit that allows enough room for the body to enter the wetsuit, while retaining a snug fit and proper water seal, is still a challenge that has not been completely addressed.

SUMMARY OF THE DISCLOSURE

It is an object of the present invention to provide a zipperless neoprene wetsuit that overcomes the problems discussed above.

In order to accomplish the objects of the present invention, the present invention provides a zipperless wetsuit which eliminates the problems described above. The wetsuit according to the present invention will provide better comfort, better fit, convenience, and a faster swim.

The present invention provides a neoprene wetsuit having a back, a neck portion at the top the back, and an access opening at the neck portion. The wetsuit has a closure system provided at the access opening. The closure system has an internal gasket made of a generally V-shaped piece of flexible material having an upper edge and two side edges, and a collar connected to the upper edge of the gasket. An inner flap is hingedly attached to one of the side edges of the gasket, and has an outwardly-facing surface, with at least one Velcro™ pad provided thereon. An outer flap is hingedly attached to another of the side edges of the gasket, and has an inwardly-facing surface, with at least one Velcro™ pad provided thereon. Magnet pieces can also be provided on the outwardly-facing surface of the inner flap and the inwardly-facing surface of the outer flap to facilitate the closure of outer flap on to the inner flap.

The closure system of the present invention solves the above problems, providing simple entry and effective closure while retaining the look and sleekness of a traditional back zip swim wetsuit.

DETAILED DESCRIPTION OF THE PREFERRED EMBODIMENTS

Figures 1, 2, 3:
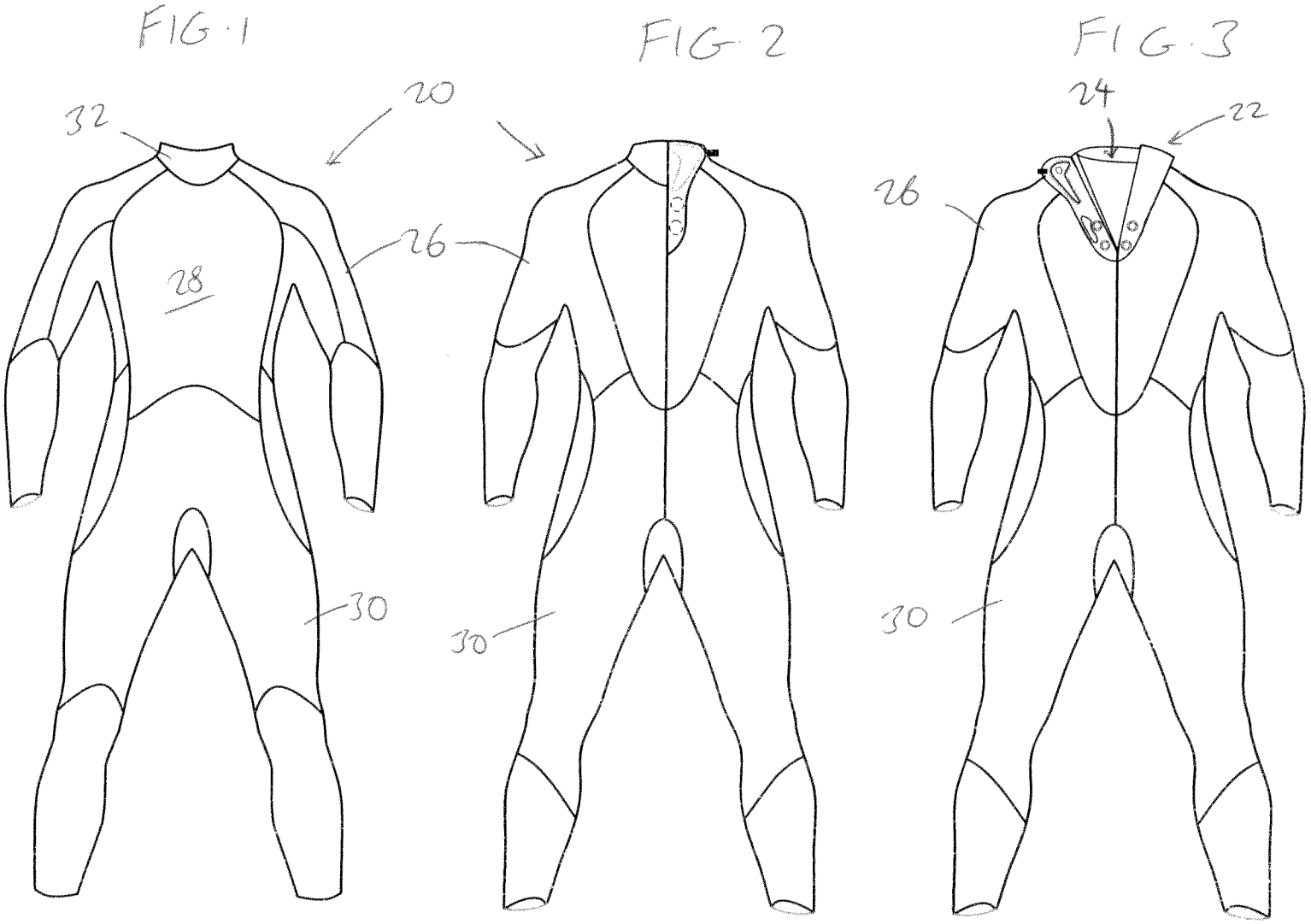
FIG. 1 is a front view of a wetsuit according to one embodiment of the present invention.
FIG. 2 is a rear view of the wetsuit of FIG. 1 shown with the closure system in the closed position.
FIG. 3 is a rear view of the wetsuit of FIG. 1 shown with the closure system in the opened position.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices and mechanisms are omitted so as to not obscure the description of the present invention with unnecessary detail.

The present invention provides a zipperless wetsuit 20 having a back-entry closure system 22 at a rear access opening 24 that provides quick and convenient access for a swimmer to get into and out of the wetsuit 20. The wetsuit 20 can be used as any type of swimming wetsuit, including but not limited to triathlon wetsuits, diving wetsuits, surfing wetsuits, wetsuits for use with canoeing or kayaking, or any other water sports. The wetsuit 20 can be made of neoprene and laminated fabrics.

FIGS. 1-4 illustrate one embodiment of the present invention. The wetsuit 20 can be configured like a traditional wetsuit with arm portions 26, a torso portion 28, and leg portions 30. An access opening 24 is provided on the back or rear of the wetsuit 20, adjacent the neck portion 32. A closure system 22 is provided at the access opening 24.

Figure 4:
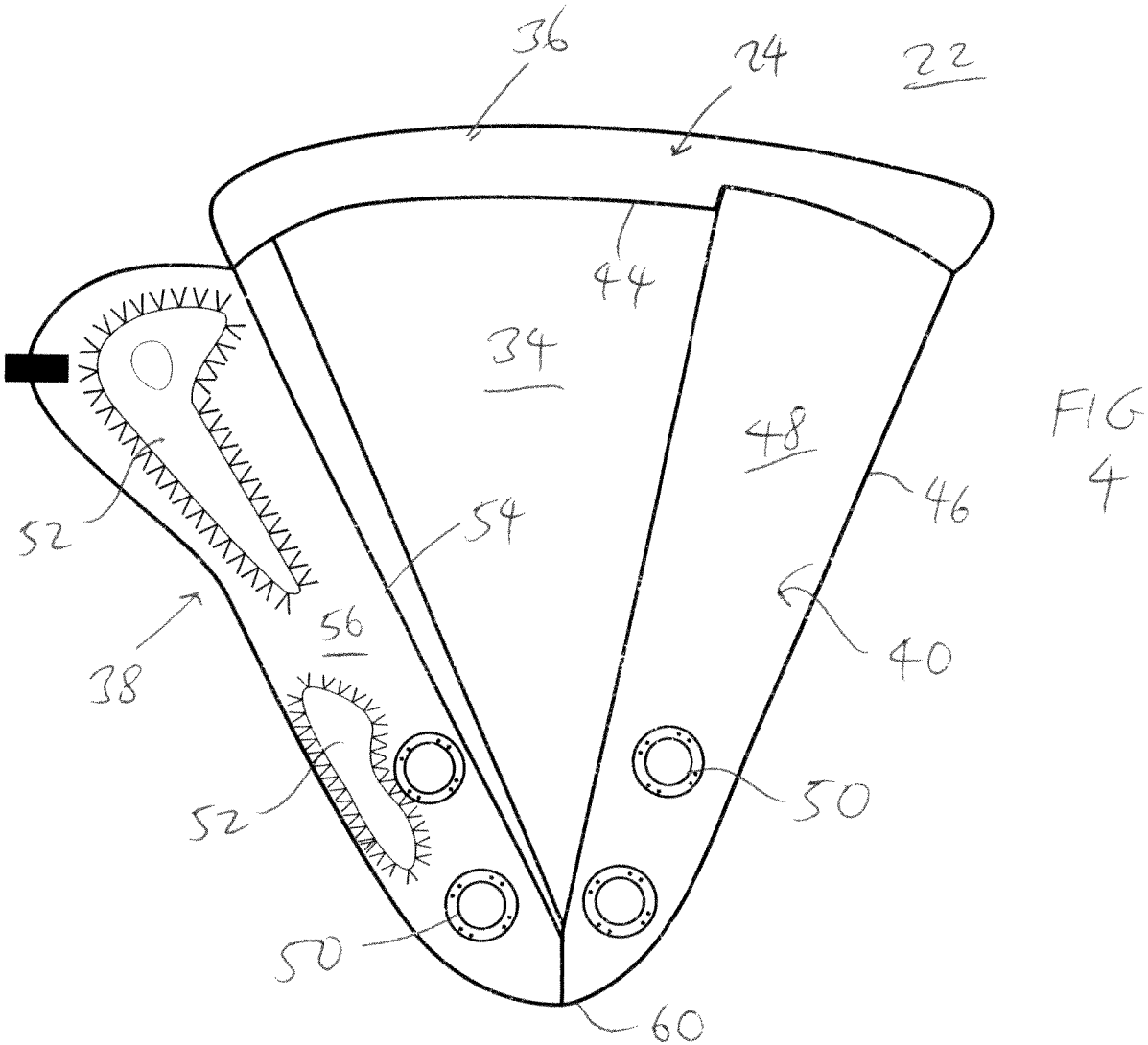
FIG. 4 is an enlarged perspective view of the closure system for the wetsuit of FIG. 1.

The closure system 22 is shown in greater detail in FIG. 4, and includes an internal gasket 34, a collar 36, an outer flap 38, and an inner flap 40. The gasket 34 is a generally V-shaped piece of material that can be made of flexible materials such as neoprene, latex, rubber, waterproof fabric, synthetic materials, silicon, etc. The gasket 34 functions to provide a seal that blocks water from entering the inside of the wetsuit 20. The collar 36 is connected to the upper edge 44 of the gasket 34 at the location of the neck portion 32. The circumference formed by the gasket 34 and the collar 36 needs to be flexible and sized large enough to allow for the body to enter the wetsuit 20 through the access opening 24.

The outer flap 38 and the inner flap 40 can each be a piece of flexible material that can be made from any of the materials used for the gasket 34 as described above. The inner flap 40 has one edge 46 that is hingedly attached (e.g., by stitching) to one side edge of the gasket 34, and has an outwardly-facing surface 48. At least one magnet piece 50 is provided (e.g., sewn) on the outwardly-facing surface 48 at the lower end of the inner flap 40. The entire outwardly-facing surface 48 can be provided in the form of a single Velcro™ loop pad. Even though FIG. 4 illustrates a single Velcro™ loop pad that is laminated or otherwise provided over the entire surface area of the outwardly-facing surface 48, and two magnet pieces 50, any number of Velcro™ loop pads and magnet pieces 50 can be used. For example, a plurality of Velcro™ loop pads can be positioned on the outwardly-facing surface 48 at locations that would be aligned with the corresponding pads 52 on the outer flap 38 when the outer flap 38 is folded on top of the inner flap 40.

The outer flap 38 has one edge 54 that is hingedly attached (e.g., by stitching) to the other side edge of the gasket 34, and has an inwardly-facing surface 56. At least one magnet piece 50 is provided on the inwardly-facing surface 56 at the lower end of the outer flap 38 (and aligned with the magnet piece(s) 50 on the inner flap 40), and at least one Velcro™ hook pad 52 is provided at other locations on the inwardly-facing surface 56 of the outer flap 38. Even though FIG. 4 illustrates two pads 52, and two magnet pieces 50, any number of pads 52 and magnet pieces 50 can be used.

In use, the swimmer stretches the access opening 24 and steps into the wetsuit 20 through the access opening 24. After inserting the arms and legs into the arm portions 26 and leg portions 30, the swimmer simply reaches behind to his or her back and flips the inner flap 40 over the access opening 24 to expose the outwardly-facing surface 48. Next, the swimmer flips the outer flap 38 over the outwardly-facing surface 48 of the inner flap 40, and the magnet pieces 50 on both flaps 38, 40 will attract each other, thereby pulling the inner-facing surface 56 of the outer flap 38 towards the outwardly-facing surface 48 of the inner flap 40. The aligned magnet pieces 50 will attach to each other, and then the swimmer can press the outer flap 38 against the inner flap 40 so that the Velcro™ pads 52 and 48 will engage each other to complete the connection. The outer flap 38 will then be secured against the inner flap 40 to provide a sealed and water-proof connection. The fact that the gasket 34 is V-shaped with two side edges that meet at an apex 60 allows the lower parts of the flaps 38 and 40 to meet near the apex 60, and with the magnet pieces 50 positioned near the apex 60, the relative proximity of the magnet pieces 50 allows the magnetic attraction to pull the outer flap 38 towards the inner flap 40. As a result, a zippered closure can be avoided, while the closure system 22 provides a water-tight seal that is easy and convenient to use because the location of the closure system 22 (and in particular the apex 60) is usually near the upper middle back area which is difficult to reach by hand.

Figure 5:
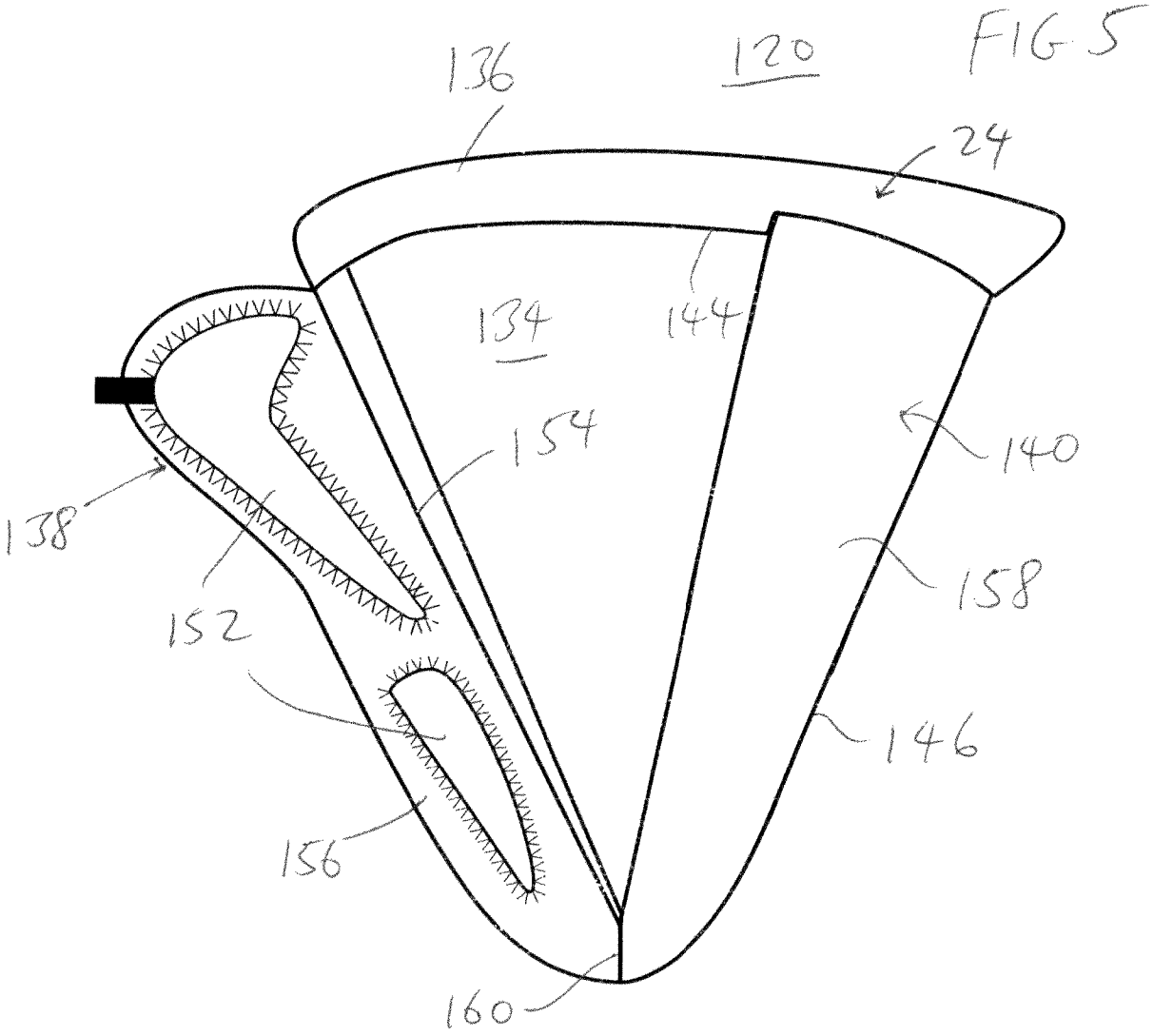
FIG. 5 is an enlarged perspective view of a closure system according to another embodiment of the present invention which can be used for the wetsuit of FIG. 1.

FIG. 5 illustrates a closure system 120 according to another embodiment of the present invention. The closure system 120 includes an internal gasket 134, a collar 136, an outer flap 138, and an inner flap 140. The gasket 134 is also a generally V-shaped piece of material that can be made of flexible materials such as neoprene, latex, rubber, water-proof fabric, synthetic materials, silicon, etc. The gasket 134 functions to provide a seal that blocks water from entering the inside of the wetsuit 20. The collar 136 is connected to the upper edge 144 of the gasket 134 at the location of the neck portion 32. The circumference formed by the gasket 134 and the collar 136 also needs to be flexible and sized large enough to allow for the body to enter the wetsuit 20 through the access opening 24.

The outer flap 138 and the inner flap 140 can each be a piece of flexible material that can be any of the materials used for the gasket 134 as described above. The inner flap 140 has one edge 146 that is hingedly attached (e.g., by stitching) to one side edge of the gasket 134, and has an outwardly-facing surface 158 that can be provided in the form of a single Velcro™ loop pad that is laminated or otherwise provided over the entire surface area of the outwardly-facing surface 158. Even though FIG. 5 illustrates a single Velcro™ loop pad that is laminated or otherwise provided over the entire surface area of the outwardly-facing surface 158, any number of Velcro™ loop pads can be used. For example, a plurality of Velcro™ loop pads can be positioned on the outwardly-facing surface 158 at locations that would be aligned with the corresponding pads 152 on the outer flap 138 when the outer flap 138 is folded on top of the inner flap 140.

The outer flap 138 has one edge 154 that is hingedly attached (e.g., by stitching) to the other side edge of the gasket 134, and has an inwardly-facing surface 156. At least one Velcro™ hook pad 152 is provided on the inwardly-facing surface 156 of the outer flap 138. Even though FIG. 5 illustrates two pads 152, any number of pads 152 (including a single pad 152 laminated over the entire inwardly-facing surface 156) can be used.

In use, the swimmer stretches the access opening 24 and steps into the wetsuit 20 through the access opening 24. After inserting the arms and legs into the arm portions 26 and leg portions 30, the swimmer simply reaches behind to his or her back and flips the inner flap 140 over the access opening 24 to expose the pad 158. Next, the swimmer flips the outer flap 138 over the pad 158 of the inner flap 140, and then presses the outer flap 138 against the inner flap 140 so that the Velcro™ pads 152 and 158 will engage each other to complete the connection. The outer flap 138 will then be secured against the inner flap 140 to provide a sealed and water-proof connection. Again, a zippered closure can be avoided, while the closure system 120 provides a water-tight seal that is easy and convenient to use because the location of the closure system 120 (and in particular the apex 160) is usually near the upper middle back area which is difficult to reach by hand.

The closure systems 20 and 120 are shown as having a right-opening orientation in that the inner flap 40, 140 is on the right side. The closure systems 20, 120 can be left-opening oriented if the inner flap 40, 140 is provided on the left side, as shown in FIGS. 6A-6C.

Figure 6C:
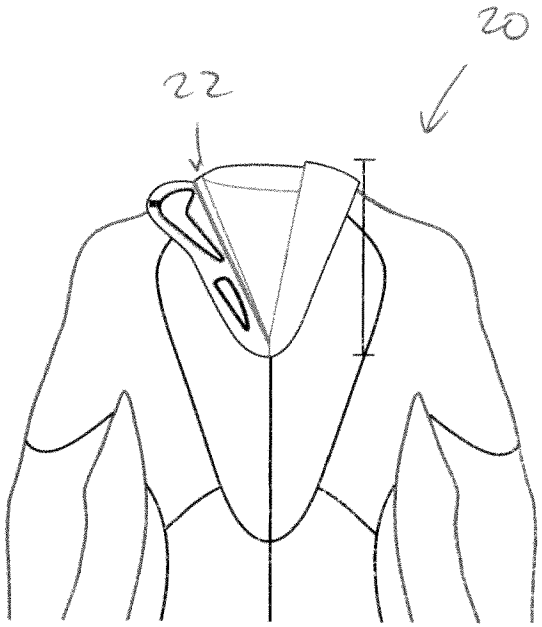
FIGS. 6A-6C show that the length and width of the access opening can be varied to match different user sizes.
Figure 6B:
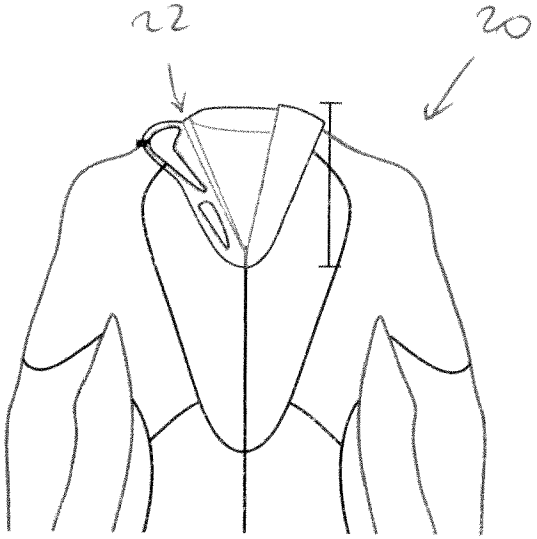
Figure 6A:
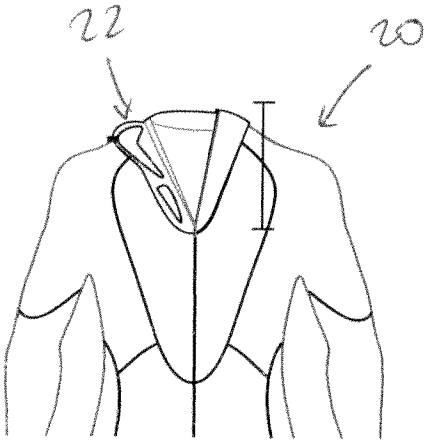

In addition, FIGS. 6A-6C show that the length and width of the access opening 24 can be varied to match different user sizes.

Figure 7C:
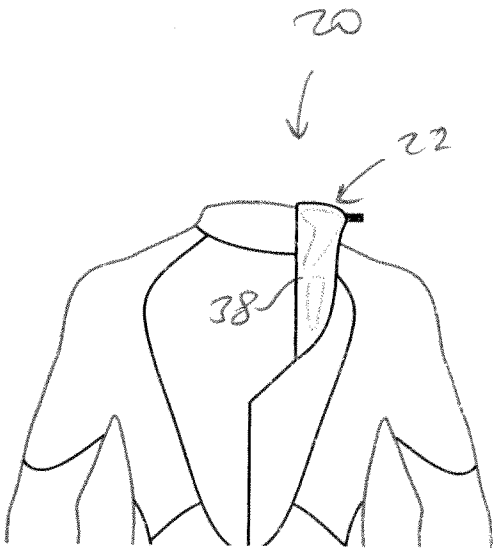
FIG. 7C shows a right biased positioning for the flaps.
Figure 7B:
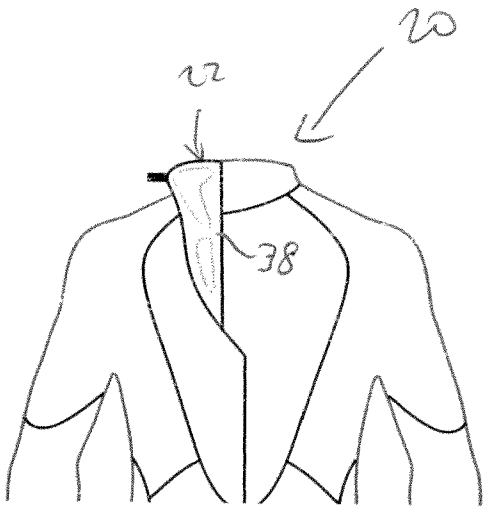
FIG. 7B shows a left biased positioning for the flaps.
Figure 7A:
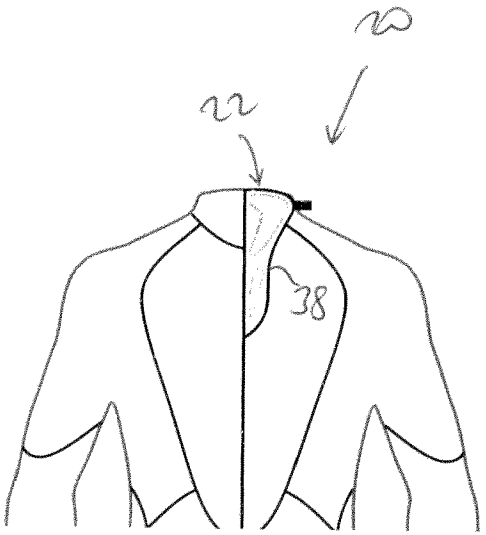
FIG. 7A shows a middle or centerline positioning for the flaps.

Finally, the embodiments shown in FIGS. 1-6C show closure systems 20, 120 where the positions of the flaps 38, 138, 40, 140 are set at a centerline or middle. It is also possible to set the positions of the flaps 38, 138, 40, 140 in a left biased (see FIG. 7B) or right biased (see FIG. 7C) position where the outer flap 38, 138 is positioned towards the left (left-biased in FIG. 7B) or right side (right-biased in FIG. 7C) away from the centerline. FIG. 7A shows the centerline position to compare and contrast the left and right biased positions shown in FIGS. 7B and 7C, respectively. Here, note that FIGS. 7A and 7C show right-opening orientation and FIG. 7B shows left-opening orientation. The biased positions provide more options and better ease of use for a swimmer, as different swimmers may find different flap positions to be easier to get into and out of the wetsuit 20.

The above detailed description is for the best presently contemplated modes of carrying out the invention. This description is not to be taken in a limiting sense, but is made merely for the purpose of illustrating general principles of embodiments of the invention. The scope of the invention is best defined by the appended claims. In certain instances, detailed descriptions of well-known devices, components, mechanisms and methods are omitted so as to not obscure the description of the present invention with unnecessary detail.

What is claimed is:

1. A neoprene wetsuit having a back portion, a front portion, and a neck portion at a top the back portion, and an access opening at the back portion adjacent the neck portion, the wetsuit having a closure system provided at the access opening and comprising: an internal gasket made of a generally V-shaped piece of flexible material having an upper edge and two side edges that meet at an apex;

a collar connected to the upper edge of the gasket;

an inner flap hingedly attached to one of the side edges of the gasket, and having an outwardly-facing surface, with at least one magnet piece provided on the outwardly-facing surface adjacent the apex, and at least one fastener provided on the outwardly-facing surface; and an outer flap hingedly attached to another of the side edges of the gasket, and having an inwardly-facing surface, with at least one magnet piece provided on the inwardly-facing surface adjacent the apex, and the at least one fastener provided in spaced-apart location from the at least one magnet piece of the outer flap on the inwardly-facing surface of the outer flap;

wherein the outer flap is secured to the inner flap when the at least one magnet piece of the inner flap is connected to the at least one magnet piece of the outer flap.

2. The neoprene wetsuit of claim 1, wherein the internal gasket is made of a flexible material, such as neoprene, latex, rubber, waterproof fabric, synthetic materials, or silicon.

3. The neoprene wetsuit of claim 1, wherein the at least one fastener provided on the outwardly-facing surface covers the outwardly-facing surface.

4. The neoprene wetsuit of claim 1, wherein the inner flap is positioned on a left side edge of the gasket and the outer flap is positioned on a right side edge of the gasket.

5. The neoprene wetsuit of claim 1, wherein the outer flap is positioned on a left side edge of the gasket and the inner flap is positioned on a right side edge of the gasket.

6. The neoprene wetsuit of claim 1, wherein the closure system has a centerline, and the outer flap is positioned to the right of the centerline.

7. The neoprene wetsuit of claim 1, wherein the closure system has a centerline, and the outer flap is positioned to the right of the centerline.

8. A neoprene wetsuit having a back portion, a front portion, and a neck portion at a top the back portion, and an access opening at the back portion adjacent the neck portion, the wetsuit having a closure system provided at the access opening and comprising: an internal gasket made of a generally V-shaped piece of flexible material having an upper edge and two side edges that meet at an apex;

a collar connected to the upper edge of the gasket;

an inner flap hingedly attached to one of the side edges of the gasket, and having an outwardly-facing surface, with at least one fastener provided adjacent the apex; and an outer flap hingedly attached to another of the side edges of the gasket, and having an inwardly-facing surface, with the at least one fastener provided adjacent the apex;

wherein the outer flap is secured to the inner flap when at least one magnet piece of the inner flap is connected to at least one magnet piece of the outer flap.

9. The neoprene wetsuit of claim 8, wherein the internal gasket is made of a flexible material, such as neoprene, latex, rubber, waterproof fabric, synthetic materials, or silicon.

10. The neoprene wetsuit of claim 8, wherein the inner flap is positioned on a left side edge of the gasket and the outer flap is positioned on a right side edge of the gasket.

11. The neoprene wetsuit of claim 8, wherein the outer flap is positioned on a left side edge of the gasket and the inner flap is positioned on a right side edge of the gasket.

12. The neoprene wetsuit of claim 8, wherein the closure system has a centerline, and the outer flap is positioned to the right of the centerline.

13. The neoprene wetsuit of claim 8, wherein the closure system has a centerline, and the outer flap is positioned to the left of the centerline.

* * * * *